219-121
6/26/79 XR 4,159,440 SR

United States Patent [19]

Little

[11] 4,159,440

[45] Jun. 26, 1979

[54] DIELECTRIC GUIDE FOR ELECTRON BEAM TRANSPORT

[75] Inventor: Roger G. Little, Bedford, Mass.

[73] Assignee: Spire Corporation, Bedford, Mass.

[21] Appl. No.: 870,944

[22] Filed: Jan. 20, 1978

Related U.S. Application Data

[62] Division of Ser. No. 548,438, Feb. 10, 1975, Pat. No. 4,079,285.

[51] Int. Cl.[2] ..... H01J 23/16; H01J 29/96

[52] U.S. Cl. ..... 315/3; 313/352; 313/361; 250/396 R; 219/121 EB

[58] Field of Search ..... 315/3, 4, 5; 313/421, 313/423, 424, 361, 450, 474, 352, 355; 250/396; 219/121 EB

[56] References Cited

U.S. PATENT DOCUMENTS

| | | | |
|---|---|---|---|
| 3,412,196 | 11/1968 | Figgins | 250/396 X |
| 3,914,637 | 10/1975 | Bennett | 250/396 X |
| 4,079,285 | 3/1978 | Little | 313/355 |

*Primary Examiner*—Saxfield Chatmon, Jr.

[57] ABSTRACT

An evacuated enclosure in the form of a cylindrical cavity having a dielectric located therein defines a dielectric guide for transporting an electron beam introduced into the cavity. The dielectric, which is disposed about the cavity wall, is operative to trap the charge associated with normal vacuum expansion of the electron beam. The trapped charge, in cases where the injected electron beam is not space charge limited, modifies the electric fields within the cavity in such a way as to provide focusing forces on the electron beam propagating through the cavity, the focusing forces being sufficient to quide a major portion of the beam through the enclosure without attenuation. Within the injected beam is space charge limited, the trapped charge induces an electrical discharge—either surface flashover or volume puncture of the dielectric—which liberates gaseous material. This gas then ionizes, is attracted by space charge electric fields into the body of the beam, and provides space charge neutralization. In this situation the beam is confirmed by its self-magnetic field and propagates through the cavity with little attenuation.

6 Claims, 14 Drawing Figures

DIELECTRIC GUIDE FOR ELECTRON BEAM TRANSPORT

CROSS REFERENCE TO RELATED APPLICATIONS

This is a division of application Ser. No. 548,438, filed on Feb. 10, 1975, now U.S. Pat. No. 4,079,285.

BACKGROUND OF THE INVENTION

1. Field of Invention

The present invention generally relates to devices for guiding electron beams and, more particlarly, is directed toward a dielectric guide for electron beam transport.

2. Description of the Prior Art

Propogation of electron beams for an appreciable length in a vacuum enclosure is inefficient unless some form of guiding field is used. The reason for such inefficiency is due to the repulsive space charge forces associated with the electrical charge on each electron that cause the beam to expand outwardly in the radial direction. The beam strikes the walls of the vacuum envelope and is lost. Several devices have been designed for controlling radial expansion of the electron beam. In one device, which has limited application, the electrical charge of the electron beam is neutralized by means of a background plasma. The self-magnetic field of the beam causes it to pinch inwardly for improving transport efficiency. Another device employs magnetic guide fields. Generally, a solenoidal field is used and the transverse motion of the beam is limited to a rotational mode rather than a radial mode. Under certain circumstances, efficient beam propogation is possible with the use of rather large magnetic fields. Magnetic field devices suffer from the disadvantage that the cost of the solenoid necessary to generate the magnetic field is excessively high and comparable to the cost of the main beam accelerator. Furthermore, there are situations in which it is desired not to have magnetic fields present, whereby magnetic field devices have limited application. A need has arisen for an inexpensive and efficient device of general application for electron beam transport in a vacuum which requires neither control of a background plasma environment nor costly equipment to provide guide fields.

SUMMARY OF THE INVENTION

It is an object of the present invention to provide a dielectric guide for electron beam transport in a vacuum which does not suffer from the heretofore described disadvantages and limitations. The present invention is characterized by a dielectric guide in the form of an enclosure defining a cylindrical cavity through which an electron beam is directed. A dielectric disposed within the cavity is operative to provide focusing action for the propogating electron beam. In a typical embodiment, the interior surface of the enclosure is lined with a dielectric material. An initial portion of an electron beam injected into the cavity diverges outwardly in a radial pattern towards the dielectric material as a result of space charge forces. The radially diverging portion of the beam impacts upon the dielectric material and the charge associated with the electron beam is trapped by the dielectric material. The trapped charge either induces a negative potential on the dielectric material surface, which reflects subsequent electrons amd generates a focusing field or induces an electrical discharge of the dielectric, which provides gaseous material that space charge neutralizes the beam and thus prevents further radial expansion. The initial minor portion of the electron beam establishes the focusing action and the remaining major portion of the electron beam is transported through the evacuated cavity unattenuated.

Other and further objects of the present invention will in part be obvious and will in part appear hereinafter.

The invention accordingly comprises the device possessing the construction, combination of elements, and arrangement of parts that are exemplified in the following detailed disclosure, the scope of which will be indicated in the appended claims.

BRIEF DESCRIPTION OF THE DRAWINGS

For a fuller understanding of the nature and objects of the present invention, reference should be had to the following detailed description taken in connection with the drawings wherein.

DETAILED DESCRIPTION OF THE PREFERRED EMBODIMENTS

The present invention contemplates a dielectric guide for electron beam transport in a vacuum environment. Generally, the dielectric guide is in the form of an enclosure defining a cylindrical cavity through which an electron beam propogates, the cavity being evacuated. A dielectric material is disposed within the evacuated cavity for interaction with an electron beam injected into the cavity. The dielectric material is operative to provide focusing action on the propogating electron beam for guiding the beam through the cavity without attenuation.

Figure 1:
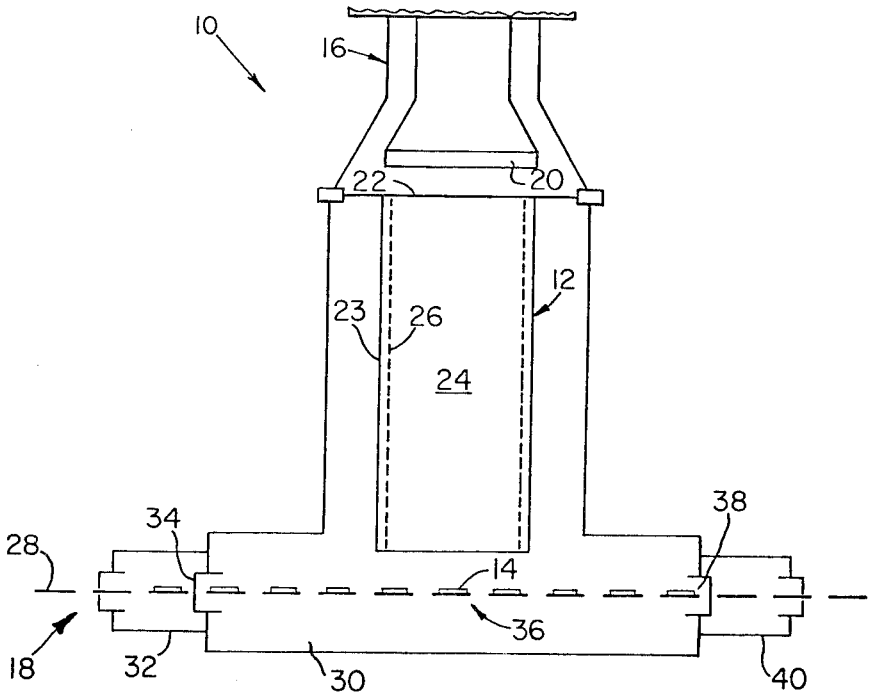
FIG. 1 is a schematic diagram of a system for thermal processing of semiconductors including a dielectric guide embodying the present invention.

Referring now to the drawings, particularly FIG. 1, there is shown a system 10, which includes a dielectric guide 12 embodying the invention, for thermal processing of semiconductors 14. System 10 comprises an electron beam generator 16, dielectric guide 12 and a transport system 18. Electron beam generator 16 includes an emitter 20 and an acceleration anode 22. In the illustrated embodiment of FIG. 1, dielectric guide 12 includes an enclosure 23 that defines a cylindrical cavity 24 having a dielectric material 26 about the inner surface thereof. Transport system 18 includes an endless belt 28 that carries semiconductors 14 into a vacuum chamber 30, which is at a pressure of approximately $2\times\times10^{-4}$ Torr. Dielectric guide 12 is disposed within vacuum chamber 30. Electrons emitted from emitter 20 are accelerated towards anode 22, for example a high transparency mesh that serves both as an accelerator anode and as one end of cavify 24, the other end of cavity 24 being opened.

Figure 2:
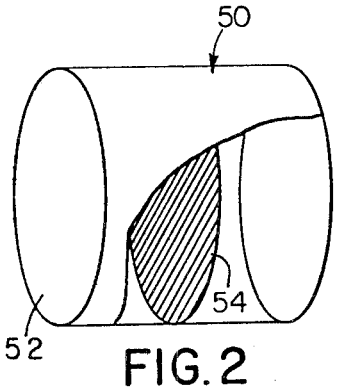
FIG. 2 is a perspective view, partly cutaway, of a perpendicular dielectric guide.
Figure 3:
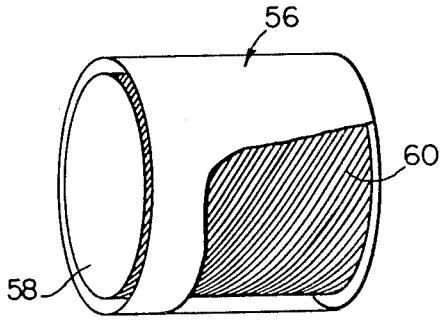
FIG. 3 is a perspective view, partly cutaway, of a sidewall dielectric guide.
Figure 4:
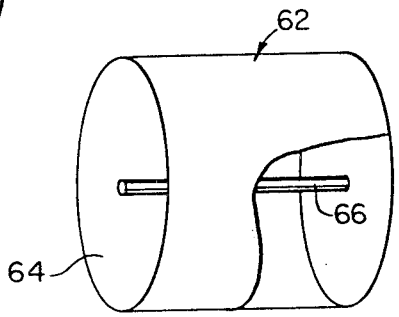
FIG. 4 is a perspective view, partly cutaway, of a coaxial rod dielectric guide.

In the illustrated embodiment, by way of example, the thermal processing of semiconductors 14 is an anneling process for annealing the surface regions of the semiconductors. Semiconductors 14, which are to be processed, are positioned on endless belt 28 and are carried through an entrance chamber 32 and vacuum interlock 34 to a processing station 36 in vacuum chamber 30. The travel path of endless belt 28 is disposed in perpendicular relationship with the longitudinal axis of cavity 24. Processing station 36 is located in registration with the open end of cavity 24 so that the propogating electron beam impacts upon the surface regions of semiconductors 14 that are to be processed. The initial portion of the electron beam injected into cavity 24 diverges radially and outwardly towards dielectric material 26 due to space charge forces. The radially diverging portion of the beam impacts upon dielectric material 26 and the charge associated with the normal vacuum expansion of the electron beam is trapped by the dielectric material. The trapped charge either induces a negative potential on the dielectric surface, which reflects subsequent electrons and generates a focusing field or induces an electrical discharge of the dielectric, which provides gaseous material that space charge neutralizes the beam and thus prevents further radial expansion. The initial minor portion of the electron beam establishes the focusing action and the remaining major portion of the electron beam is guided through evacuated cavity 24 unattenuated. The electron beam, which is characterized by a pulse duration in the range of $10^{-9}$ to $10^{-1}$ seconds, impacts upon the surface region of semiconductor 14. The effect of the impacting short duration pulse is to momentarily elevated the temperature of the surface regions of the semiconductor above the temperature at which annealing occurs witout subjecting the remaining regions of the semiconductor to undesireable thermal exposure. The processed semiconductors pass out of vacuum chamber 30 through a vacuum interlock 38 and into an exit chamber 40. Detailed examples of dielectric guide configurations, which embody the present invention, are shown in FIGS. 2, 3 and 4. In FIG. 2, there is shown a dielectric guide 50 that defines a cylindrical cavity 52 having a thin dielectric sheet 54 mounted therein. Sheet 54 has a dielectric thickness in the range of 0.1 to 10.0 milligrams per square centimeter. Dielectric sheet 54 is mounted in a plane that is in perpendicular relationship with the longitudinal axis of cavity 52 at the mid-plane thereof. The configuration of FIG. 3 is a dielectric guide 56 that defines a cylindrical cavity 58 having a thin dielectric stratum 60 disposed about the cavity boundary. Stratum 60 has a dielectric thickness greater than 10.0 milligrams per square centimeter. Dielectric stratum 60 defines a surface of revolution that is coaxial with the longitudinal axis of cavity 58. The illustrated embodiment of FIG. 4 represents a dielectric guide 62 that defines a cylindrical cavity 64 having a dielectric rod 66 disposed coaxially with the longitudinal axis of the cavity. Rod 54 has a dielectric thickness greater than 1.0 milligram per square centimeter.

Figure 5:
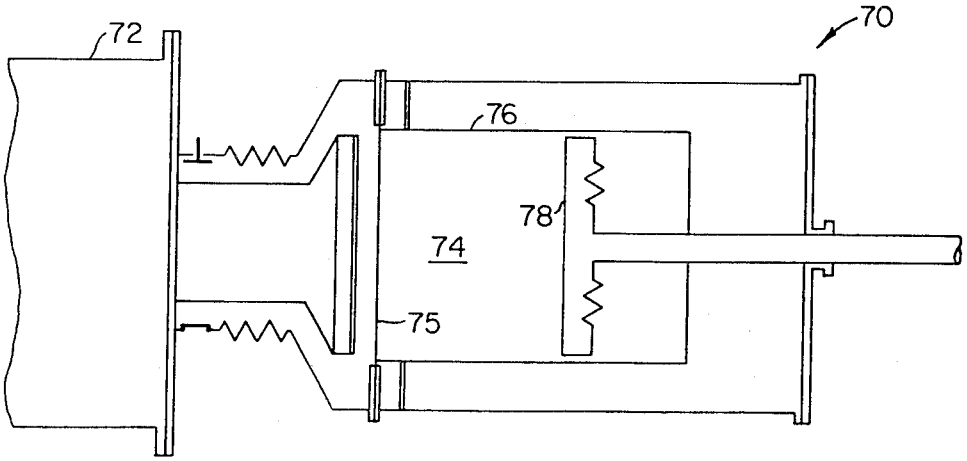
FIG. 5 is a schematic diagram of a test system for measuring properties of an electron beam transported through the dielectric guides of FIG. 2, 3 and 4.
Figure 6:
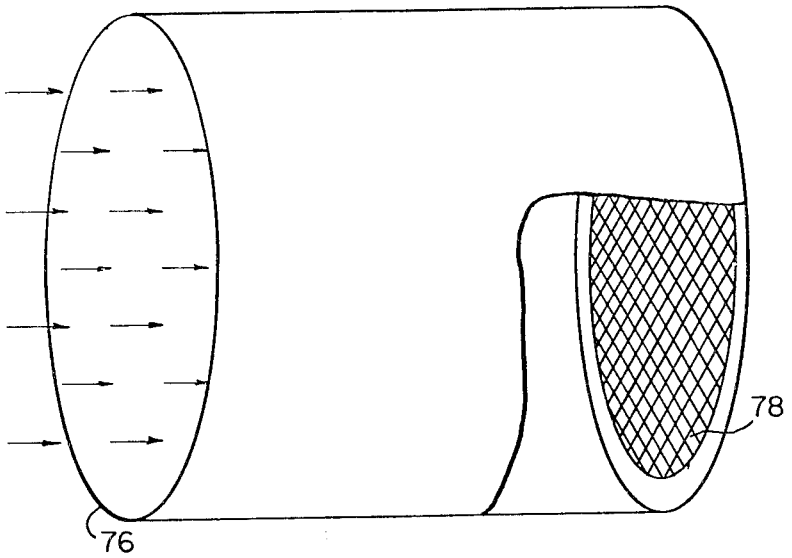
FIG. 6 is a perspective view of the general configuration of the dielectric guide used in the test system of FIG. 5.
Figure 7:
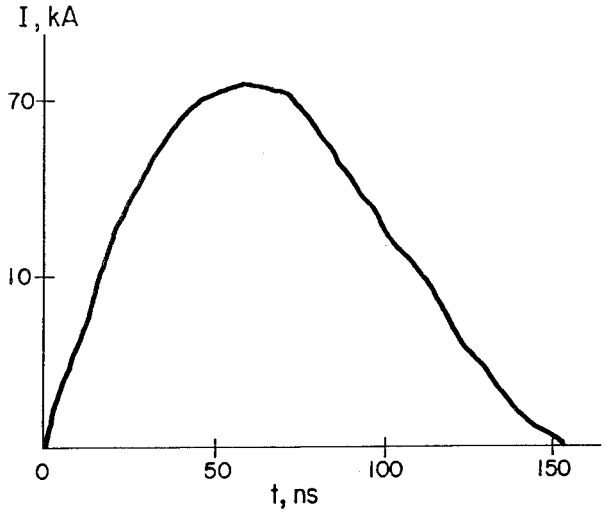
FIG. 7 is a graphical representation of typical accelerator anode voltage.
Figure 8:
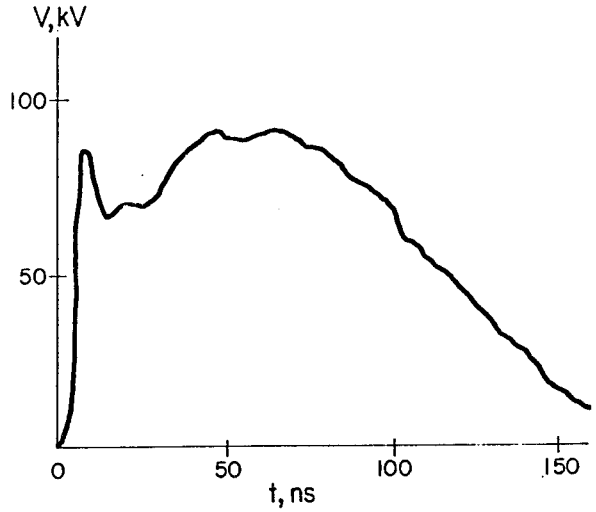
FIG. 8 is a graphical representation of typical accelerator anode current.
Figure 9:
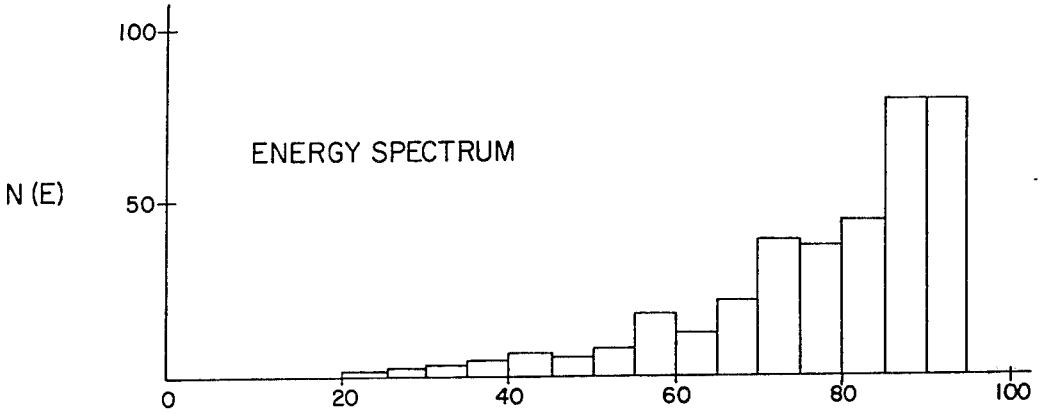
FIG. 9 is a graphical representation of the energy spectrum of the electron beam.
Figure 10:
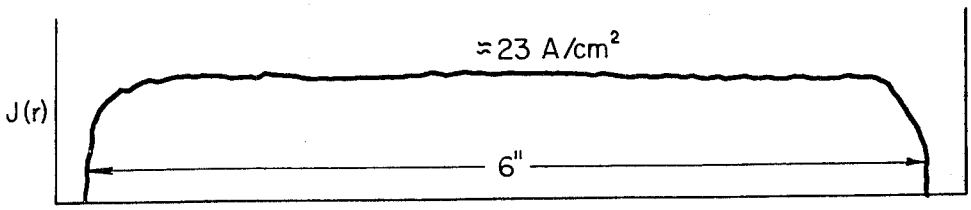
FIG. 10 is a graphical representation of current density distribution at injection into the cavity.

Referring now to FIG. 5, there is shown a test system 70 for measuring the properties of an electron beam transported through the dielectric guide configurations shown in FIGS. 2, 3 and 4. Test system 70 comprises a pulsed electron beam accelerator 72 for injecting current into a cavity 74 formed in a right cylinder 76 having a diameter/length aspect ratio of approximately 1.5. The operating pressure within cavity 74 was maintained at $2\times10^{-4}$ Torr. A high transparency mesh 75 serves as both an accelerator anode and one end of cylinder 76. As best shown in FIG. 6, a Farady cup 78 for measuring net transmitted current defines the other or back end of cylinder 76. Thin film dosimeters (not shown) were mounted on the back and sidewalls during certain measurements for determining the distribution of primary charge striking these surfaces. FIGS. 7 and 8 show typical accelerator anode voltage and current traces, respectively, and the electron energy spectrum resulting therefrom is presented in FIG. 9. The measured current density distribution at injection into cavity 74 is given in FIG. 10. In the following examples, the main beam energy is approximately 80 keV, the pulse width is 90 nsec FWHM, and the current density in the range of 10–20 A/cm$^2$. The diameter of the electron beam is approximatey equal to the cavity diameter.

EXAMPLE I

Figure 11:
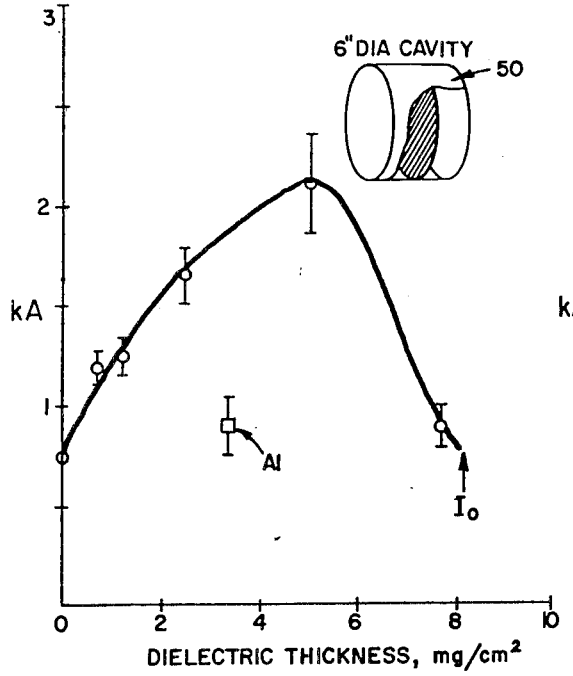
FIG. 11 is a graphical representation of the net transmitted current through the dielectric guide of FIG. 2.

In this example, a 6" diameter dielectric guide having the configuration shown in FIG. 2 was used to measure net transmitted current with a dielectric sheet, such as a polyimide sold by duPont deNemours EI & Co. under the trademark Kapton, is mounted transverse to the longitudinal axis of the cylinder at the mid-plane thereof. Transmitted current was determined as a function of dielectric thickness; the results are shown in FIG. 11. The initial linear increase in transmitted current with dielectric thickness is suggestive of volume effect. Other features that were observed experimentally are:

(1) The transmitted current pulse width decreased with increasing dielectric thickness. This is due to lower energy electrons being removed when the thickness exceeded their range.

(2) An equivalent thickness of aluminum does not show much current enhancement. This indicates that the effect of the dielectric is not to simply provide a ground plane.

(3) An anomously high enhancement was consistently observed on the first shot after a new dielectric was mounted. This is attributed to adsorbed gas on the dielectric surface being released and space charge neutralizing the beam. This effect disappeared after the first shot; the data shown in FIG. 11 represents only those shots in which there was no adsorbed gas present.

(4) A thin aluminized layer on one side of the dielectric reduced the amount of current enhancement, but did not eliminate it completely.

EXAMPLE II

Figure 12:
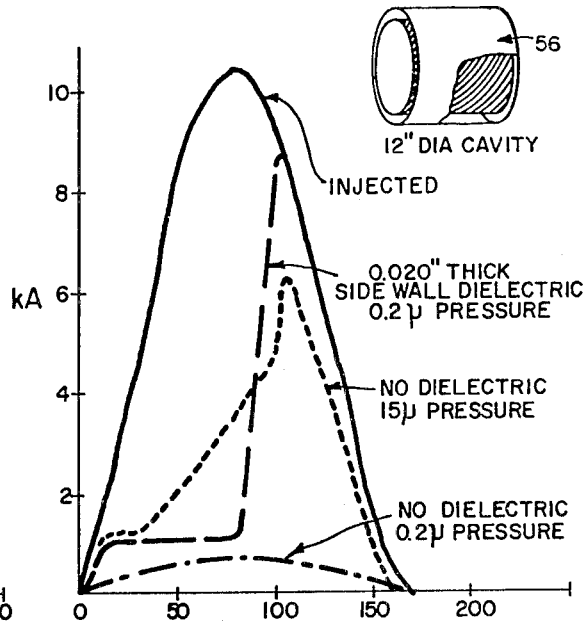
FIG. 12 is a graphical representation of the net transmitted current through the dielectric guide of FIG. 3.

In this example, both a 6" diameter and a 12" diameter dielectric gide having the configuration shown in FIG. 3 was used to measure net transmitted current, the cylinder being lined with a 0.020" thick polyethylene stratum (5 electron ranges). A representative set of transmitted current is shown in FIG. 12. A transmitted current trace for a space charge neutralized beam at $1.5\times10^{-4}$ Torr is presented also in FIG. 12 for comparison. The general features shown in FIG. 12 were observed in all cases:

(1) With no dielectric present, the transmitted current was low.

(2) With the dielectric present, the transmitted current was initially low.

(3) Roughly half-way into the injected pulse time history, there was an abrupt increase in transmitted current (dI/dt reached approximately $3\times10^{11}$ A/sec).

(4) The transmitted current became equal to the injected current; the beam was transported without any loss.

(5) The time behavior of transmitted current with the dielectric present was qualitatively different from that corresponding to space charge neutralization by an ambient gas.

(6) The thin film dosimeters indicate that the charge striking the dielectric was uniformly distributed.

A summary of the experimental data obtained is given in the following Table 1.

TABLE 1

| EXPERIMENT OBSERVATIONS SIDE WALL DIELECTRIC | | |
|---|---|---|
| Cavity Dia. (in) | 6. | 12. |
| $I_f$ (KA), No Dielectric | 0.6 | 10.7 |
| Dielectric Enhancement | 14. | 12. |
| Injected Charge (mC) | 0.74 | 0.98 |
| Wall Capacitance (pF) | 1,850. | 7,380. |
| Charge Loss (%) | 35. | 51. |
| Induced Voltage (KV) | 130. | 70. |

Dielectric Thickness = 5 electron ranges
Charge Uniformly Distributed

EXAMPLE III

Figure 13:
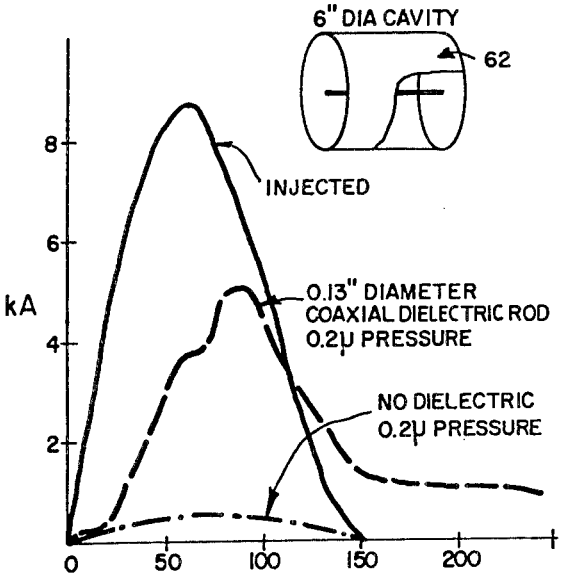
FIG. 13 is a graphical representation of the net transmitted current through the dielectric guide of FIG. 4.

In this example, a 6" diameter dielectric guide having the configuration shown in FIG. 4 was used to measure net transmitted current with a 0.130" diameter dielectric rod mounted coaxially on the cylinder center line. The rod was physically mounted on the Faraday cup, but did not touch the injection end of the cavity. FIG. 13 shows representative traces for injected and transmitted current. The main experimental results were:

(1) The beam was seen to consistantly "pinch" onto the dielectric rod at approximately 2–3 cm from the injection plane.

(2) The long tail in the transmitted current was always observed.

(3) The time behavior of the transmitted current with the coaxial dielectric rod was similar in nature to that seen when the beam was space charge neutralized by ambient gas.

Figure 14:
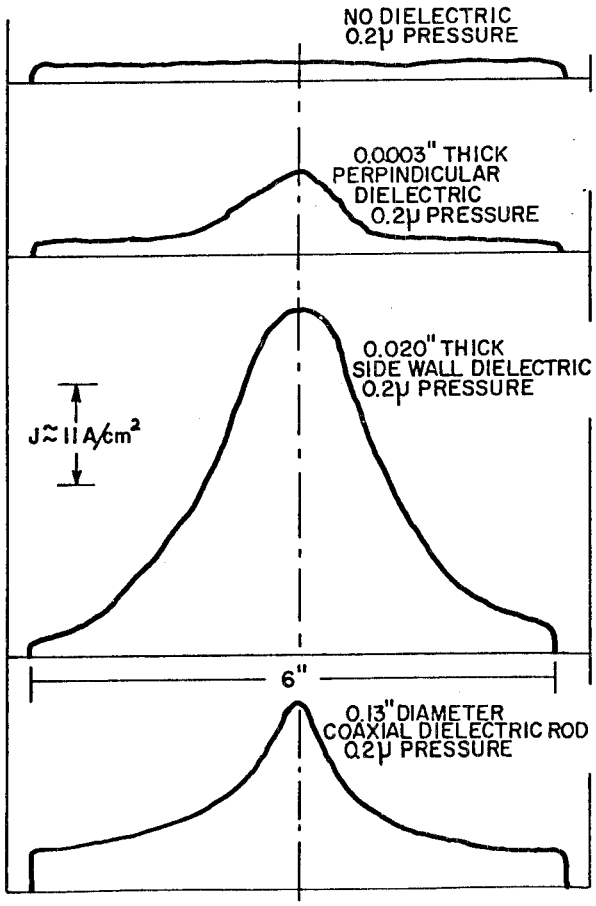
FIG. 14 is a composite graphical representation of transmitted current density distribution for the dielectric guides of FIGS. 2, 3 and 4.

FIG. 14 is a composite graphical representation which shows the current density distributions measured on the cavity back wall, using the thin film dosimeters, for the various configurations studied. In all cases in which the dielectric was present, the current density profile is similar to that of a focused or pinched beam. Combined with the time behavior of the transmitted current, this data indicates that either space charge neutralization is occuring or electric fields are created which strongly focus the beam.

SUMMARY

In the case of the perpendicular dielectric configuration of FIG. 2, the dose rate in the dielectric film generated by the primary beam is roughly $10^{13}$ rads/sec. When the primary beam first strikes the dielectric, it has a large component of radial velocity due to space charge blow-up. At these large angles of incidence some of the charge will be trapped and generate large internal electric fields. Secondary emission currents will flow out of the dielectric by a field enhanced thermionic mechanism and leave the dielectric positively charged, the charge density being sufficient to cancel the primary beam charge density within the dielectric. This localized charge neutralization alters the space charge fields in the beam enough to cause it to begin pinching. The pinching beam leaves the outer portion of the dielectric positively charged, the long charge relaxation time ensures this. The positively charged outer portion of the dielectric creates electric fields which tend to electrostatically focus the beam even more. This regenerative process continues, causing an increasingly "pinched" beam. The observed back wall current density distribution, as previously noted, indicates a tightly focused beam profile.

In the wall dielectric configuration of FIG. 3, the injected beam initially expands radially outward due to space charge forces, and strikes the dielectric where it stops and is trapped. The dose rate in the dielectric is relatively low ($10^{12}$ rads/sec) and the induced transient conductivity is low. The corresponding charge relaxation time is approximately 1.0 usec. Charge loss only occurs by surface flashover. Thus, the trapped charge induces a negative potential on the dielectric surface which reflects subsequent electrons. Ultimately the dielectric surface becomes uniformly charge, an experimental observation. The electric field induced by the tapped charge is similar to that of a unit cell in a periodic electroatatic focusing system. The initial delay in current enhancement is thus associated with charging up of the dielectric surface and generating a focusing field. Once the field is sufficient to contain the injected beam, there is a rapid rise in transmitted current. The measured current density profile of the transmitted beam is entirely consistent with a beam focusing mechanism.

In the coaxial dielectric rod configuration presented in FIG. 4, because of the plasma tail observed on the transmitted current pulse, it seems most likely that volume space charge neutralization is responsible for enhanced transport. The pinching of the beam onto the dielectric rod clearly showed that material had been eroded off. Thus, it is postulated that the initial beam pinching vaporized a thin layer of the dielectric; this gaseous material could then ionize and space charge neutralize the beam leading to a Bennett-type focusing of the beam.

CONCLUSIONS

From the foregoing, it will be readily evident that dielectric surfaces situated inside of a cavity profoundly influence the transport of charge through it. In some situations, this is attributed to vaporization of the dielectric material and subsequent space charge neutralization of the beam. In other cases, however, the dominant effect more likely arises from charge trapped on the dielectric surface. The resulting electric field provides electrostatic focusing of the beam and corresponding current enhancement.

Since certain changes may be made in the foregoing disclosure without departing from the scope of the invention herein involved, it is intended that all matter contained in the above description and shown in the accompanying drawings be construed in an illustrative and not in a limiting sense.

What is claimed is:

1. A system for thermal processing of semiconductors comprising:

(a) generator means for generating a short duration pulsed electron beam;

(b) a vacuum chamber;

(c) transport means for carrying semiconductors into said vacuum chamber;

(d) dielectric guide means for transporting said electron beam from said generator means to the semiconductors, said dielectric means including an enclosure defining a cavity adapted to have said electron beam injected therein and a sheet of dielectric material disposed within said cavity for interaction with said electron beam injected into said cavity, said cavity disposed within said vacuum chamber, said sheet of dielectric material is a thin stratum disposed about the boundary of said cavity and defines a surface of revolution which is spaced apart from the surface of said enclosure, said dielectric material interacting with said electron beam and establishing a focusing action for guiding said electron beam from said generator means through said enclosure towards the semiconductors to be processed.

2. The system as claimed in claim 1 wherein said enclosure defines a cylindrical cavity having a diameter/length aspect ratio of approximatey 1.5.

3. The system as claimed in claim 2 wherein said dielectric is in the form of thin stratum that is disposed about the boundary of said cavity.

4. A system for thermal processing of semiconductors comprising:

(a) generator means for generating an electron beam; and (b) dielectric guide means for transporting said electron beam from said generator means to the semiconductors, said dielectric means including an enclosure defining a cavity adapted to have said electron beam injected therein and a sheet of dielectric material disposed within said cavity for interaction with said electron beam injected into said cavity, said dielectric material defining a surface of revolution within said cavity, said dielectric material interacting with said electron beam and establishing a focusing action for guiding said electron beam from said generator means through said enclosure towards the semiconductors to be processed.

5. The system as claimed in claim 4 wherin said sheet of dielectric material is a thin stratum disposed about the boundary of said cavity.

6. A system for thermal processing of semiconductors comprising:

(a) generator means for generating an electron beam; and (b) dielectric guide means for transporting said electron beam from said generator means to the semiconductors, said dielectric means including an enclosure defining a cylindrical cavity adapted to have said electron beam injected therein and a single dielectric rod disposed coaxially with the longitudinal axis of said cavity for interaction with said electron beam injected into said cavity, said dielectric rod interacting with said electron beam and establishing a focusing action for guiding said electron beam from said generator means through said enclosure towards the semiconductors to be processed.

* * * * *